US011358399B2

(12) United States Patent
Shigeta

(10) Patent No.: US 11,358,399 B2
(45) Date of Patent: Jun. 14, 2022

(54) INKJET PRINTER WITH UNWINDING PART AND ADJACENT WINDING PART IN UNEVEN ARRANGEMENT

(71) Applicant: THINK LABORATORY CO., LTD., Chiba (JP)

(72) Inventor: Tatsuo Shigeta, Chiba (JP)

(73) Assignee: THINK LABORATORY CO., LTD., Chiba (JP)

( * ) Notice: Subject to any disclaimer, the term of this patent is extended or adjusted under 35 U.S.C. 154(b) by 49 days.

(21) Appl. No.: 16/957,224

(22) PCT Filed: Dec. 6, 2018

(86) PCT No.: PCT/JP2018/044822
§ 371 (c)(1),
(2) Date: Jun. 23, 2020

(87) PCT Pub. No.: WO2019/131033
PCT Pub. Date: Jul. 4, 2019

(65) Prior Publication Data

US 2021/0001649 A1 Jan. 7, 2021

(30) Foreign Application Priority Data

Dec. 25, 2017 (JP) ..... JP2017-247147

(51) Int. Cl.
*B41J 11/00* (2006.01)
*B41J 15/04* (2006.01)
*B65H 18/10* (2006.01)

(52) U.S. Cl.
CPC ..... *B41J 11/002* (2013.01); *B41J 11/0022* (2021.01); *B41J 15/04* (2013.01); *B65H 18/103* (2013.01)

(58) Field of Classification Search
CPC ..... B41J 2/01; B41J 11/002
See application file for complete search history.

(56) References Cited

U.S. PATENT DOCUMENTS 4,916,819 A * 4/1990 Gerber ..... B43L 13/022 33/1 M
2012/0024173 A1 2/2012 Berg
(Continued)

FOREIGN PATENT DOCUMENTS

CN 1915682 A 2/2007
CN 103358721 A 10/2013
(Continued)

OTHER PUBLICATIONS

Machine translation of JP 08-108530 A. (Year: 1996).*

*Primary Examiner* — Justin Seo
(74) *Attorney, Agent, or Firm* — McGlew and Tuttle, P.C.

(57) ABSTRACT

Provided is an inkjet printer with an unwinding portion and an adjacent winding portion in an uneven arrangement, which enables easy replacement of a web-shaped print base material on an unwinding portion and a winding portion for the web-shaped print base material at the time of printing on the web-shaped print base material with an aqueous ink, is capable of dealing with small-lot and wide-variety printing, and enables further space saving as compared to related arts. The inkjet printer includes: an unwinding portion for a web-shaped print base material; a single-pass inkjet head portion configured to discharge an aqueous ink to a surface of the web-shaped print base material unwound by a single-pass method; and an adjacent winding portion, which is provided adjacent to the unwinding portion, and is configured to wind the web-shaped print base material, wherein the unwinding portion and the adjacent winding portion are both installed side by side in an uneven arrangement on any one of an upstream side and a downstream side of the single-pass inkjet head portion.

7 Claims, 1 Drawing Sheet

(56) References Cited

U.S. PATENT DOCUMENTS

| | | | |
|---|---|---|---|
| 2013/0258021 | A1 | 10/2013 | Fuchioka et al. |
| 2016/0121624 | A1 | 5/2016 | Yamada et al. |
| 2016/0167403 | A1 | 6/2016 | Toya et al. |

FOREIGN PATENT DOCUMENTS

| | | | |
|---|---|---|---|
| CN | 104859298 | A | 8/2015 |
| CN | 105564044 | A | 5/2016 |
| CN | 105691009 | A | 6/2016 |
| JP | 8-108530 | A | 4/1996 |
| JP | 2000-238396 | A | 9/2000 |
| JP | 2003-311935 | A | 11/2003 |
| JP | 2010142966 | A | 7/2010 |
| JP | 2012-166497 | A | 9/2012 |
| KR | 20150011222 | A | 1/2015 |
| WO | 2017/110441 | A1 | 6/2017 |

* cited by examiner

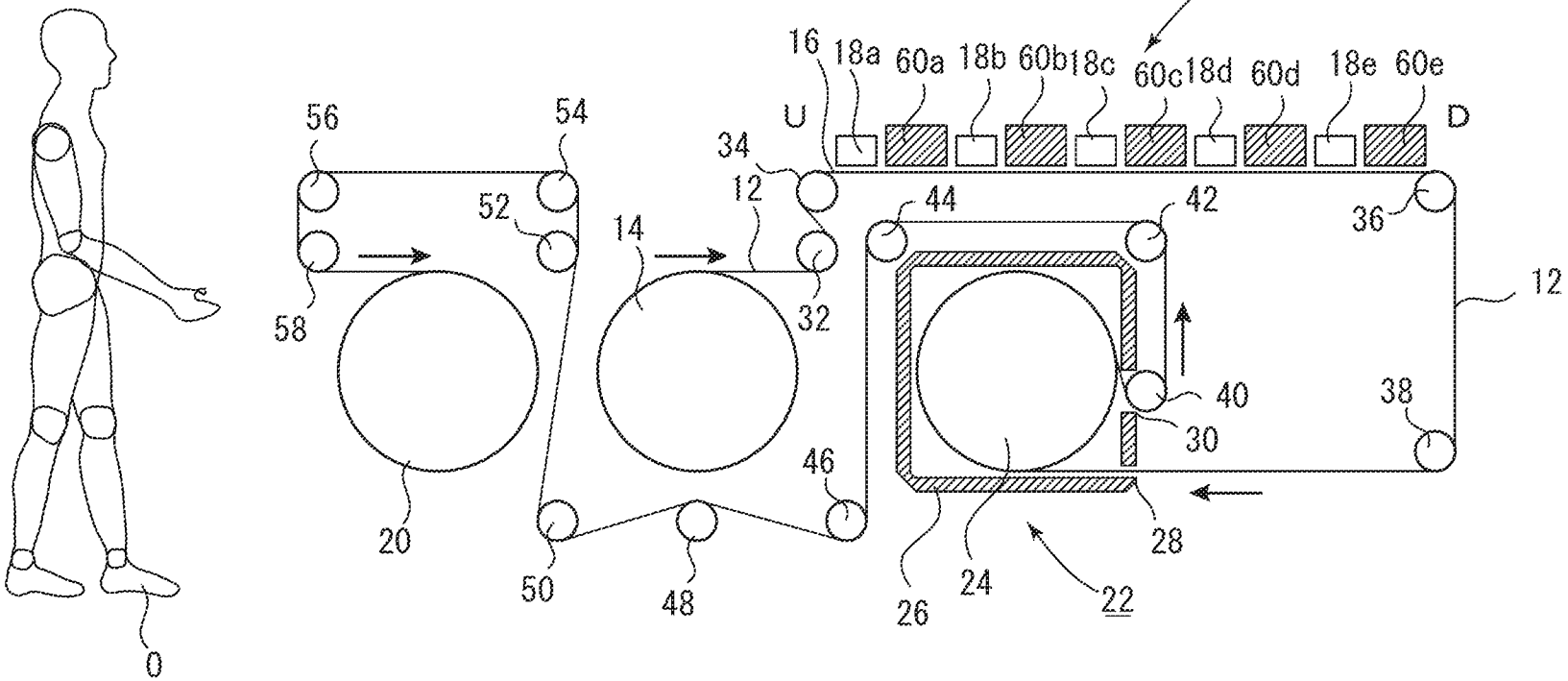
10
12
D
60e
18e
60d
18d
60c
18c
60b
18b
60a
18a
16
U
18
36
38
42
40
30
28
22
24
26
44
46
32
34
12
48
14
54
52
50
20
56
58
0

INKJET PRINTER WITH UNWINDING PART AND ADJACENT WINDING PART IN UNEVEN ARRANGEMENT

TECHNICAL FIELD

The present invention relates to an inkjet printer configured to perform printing on a web-shaped print base material by a single-pass method with an aqueous ink.

BACKGROUND ART

Hitherto, as an inkjet printer configured to perform printing on a web-shaped print base material by a single-pass method with an aqueous ink, there has been known, for example, an inkjet printer described in Patent Document 1.

Moreover, the applicant of the present application has proposed an inkjet printer described in Patent Document 2, which is well-reputed.

In those related-art inkjet printers, for conveyance of a web-shaped print base material, an unwinding portion and a winding portion for the web-shaped print base material are located on opposite sides over an inkjet head portion. That is, the unwinding portion for the web-shaped print base material is located on an upstream side of the inkjet head portion, and the winding portion for the web-shaped print base material is located on a downstream side of the inkjet head portion.

With the inkjet printer adopting the single-pass method, printing is performed while the web-shaped print base material is continuously conveyed. Therefore, as compared to an inkjet printer of a sheet-feeding type, printing can be performed on a long plastic film or a long paper. Moreover, printing by the single-pass method can be performed at higher speed as compared to an inkjet printer of a scanning type, and hence the inkjet printer adopting the single-pass method is suitable for large-lot printing.

Meanwhile, in recent years, there has been an increase in so-called small-lot and wide-variety orders such as printing orders with a small amount and different kinds. In order to deal with such small-lot and wide-variety orders, it is required that an operator frequently go back and forth between the unwinding portion for the web-shaped print base material and the winding portion for the web-shaped print base material to replace the web-shaped print base material. Thus, there arises a problem in that such an operation is cumbersome.

Moreover, an installation space for the inkjet printer is limited in many cases, and hence there has been a demand for reducing the installation space as much as possible.

PRIOR ART DOCUMENTS

Patent Documents

Patent Document 1: JP 2010-142966 A
Patent Document 2: WO 2017/110441 A1

DISCLOSURE OF THE INVENTION

Problems to be Solved by the Invention

The present invention has an object to provide an inkjet printer with an unwinding portion and an adjacent winding portion in an uneven arrangement, which enables easy replacement of a web-shaped print base material on an unwinding portion and a winding portion for the web-shaped print base material at the time of printing on the web-shaped print base material with an aqueous ink, is capable of dealing with small-lot and wide-variety printing, and enables further space saving as compared to related arts.

Means for Solving Problems

In order to solve the problems described above, according to the present invention, there is provided an inkjet printer with an unwinding portion and an adjacent winding portion in an uneven arrangement, including: an unwinding portion for a web-shaped print base material; a single-pass inkjet head portion configured to discharge an aqueous ink to a surface of the unwound web-shaped print base material by a single-pass method; and an adjacent winding portion, which is provided adjacent to the unwinding portion, and is configured to wind the web-shaped print base material, wherein the unwinding portion and the adjacent winding portion are both installed side by side in an uneven arrangement on one of an upstream side and a downstream side of the single-pass inkjet head portion.

It is preferred that the inkjet printer with an unwinding portion and an adjacent winding portion in an uneven arrangement further include a drying zone for drying a surface of the web-shaped print base material having the aqueous ink discharged thereto.

It is preferred that the unwinding portion and the adjacent winding portion are installed side by side in an uneven arrangement on an upstream side of the single-pass inkjet head portion.

The printing with an inkjet printer is sometimes called "image forming" because a digital image is formed with a dot group of discharged ink droplets.

Advantageous Effects of the Invention

According to the present invention, there can be attained a significant effect of providing the inkjet printer with an unwinding portion and an adjacent winding portion in an uneven arrangement, which enables easy replacement of the web-shaped print base material on the unwinding portion and the winding portion for the web-shaped print base material at the time of printing on the web-shaped print base material with an aqueous ink, is capable of dealing with small-lot and wide-variety printing, and enables further space saving as compared to related arts.

BRIEF DESCRIPTION OF DRAWINGS

FIG. 1 is an explanatory view for illustrating a sectional structure of one embodiment of an inkjet printer with an unwinding portion and an adjacent winding portion in an uneven arrangement according to the present invention.

DESCRIPTION OF EMBODIMENTS

The embodiment of the present invention is described below. However, the following description describes an example, and needless to say, the present invention can be modified in various ways unless departing from the technical idea of the present invention. The same elements are denoted by the same reference symbols.

FIG. 1 is an explanatory view for illustrating a sectional structure of one embodiment of an inkjet printer with an unwinding portion and an adjacent winding portion in an uneven arrangement according to the present invention. In FIG. 1, the reference symbol 10 denotes the inkjet printer with an unwinding portion and an adjacent winding portion in an uneven arrangement according to the present invention.

The inkjet printer 10 with an unwinding portion and an adjacent winding portion in an uneven arrangement includes an unwinding portion 14 for a web-shaped print base material 12, a single-pass inkjet head portion 18 configured to discharge an aqueous ink to a surface 16 of the unwound web-shaped print base material 12 by a single-pass method, and an adjacent winding portion 20, which is provided adjacent to the unwinding portion 14, and is configured to wind the web-shaped print base material 12. The unwinding portion 14 and the adjacent winding portion 20 are both installed side by side in an uneven arrangement on one of an upstream side U and a downstream side D of the single-pass inkjet head portion 18.

In the illustrated example, an illustration is given of an example of a configuration in which the unwinding portion 14 and the adjacent winding portion 20 are both installed side by side in an uneven arrangement on the upstream side U of the single-pass inkjet head portion 18. The unwinding portion 14 and the adjacent winding portion 20 are both installed in the uneven arrangement as described above, and hence an unwinding roll of the unwinding portion 14 and a winding roll of the adjacent winding portion 20 can be rotated in synchronization with each other through use of a single motor.

A configuration of the unwinding portion 14 itself is a publicly known configuration in which the unwinding roll is rotated through use of a drive belt as described in Patent Document 2. Moreover, a configuration of the adjacent winding portion 20 itself is a publicly known configuration in which the winding roll is rotated through use of a drive belt as described in Patent Document 2.

It is only required that the web-shaped print base material 12 be a web-shaped printing base material. However, it is preferred that the web-shaped print base material 12 be, for example, a transparent film, an opaque film, or a colored film. In addition, there is no particular limitation on the material for the film, and for example, a film using a synthetic resin, such as polyethylene terephthalate (PET), polyvinyl chloride (PVC), polypropylene (PP), polyethylene (PE), polystyrene (PS), or nylon (NY), may be suitably used as a web-shaped printing substrate for the film. Alternatively, a metal film obtained by forming a metal, such as aluminum, into a film shape may also be suitably used.

As the inkjet head portion 18, there are illustrated inkjet heads respectively including ink storage tanks (not shown) for cyan (C), magenta (M), yellow (Y), black (B), and white (w), and aqueous inks of respective colors are discharged from the inkjet heads 18*a* to 18*e*. Examples of the inkjet heads 18*a* to 18*e* which can be applied include various types of publicly known single-pass inkjet discharging devices. For example, an inkjet head described in Patent Document 2 can be used as each of the inkjet heads.

Moreover, surface heating portions 60*a* to 60*e* which are configured to heat at least a surface of the web-shaped print base material 12 having the aqueous inks discharged thereto are provided adjacent to the inkjet heads 18*a* to 18*e*, respectively. As each of the surface heating portions 60*a* to 60*e*, for example, a surface heating portion described in Patent Document 2 can be applied. For example, a warm-air blower described in Patent Document 2 can be applied as each of the surface heating portions 60*a* to 60*e*. When the warm-air blower is adopted as each of the surface heating portions, warm air having a temperature of from about 40° C. to 80° C., for example, 70° C. is blown onto the surface of the web-shaped print base material 12. A time period of blowing the warm air is from about 2 seconds to 3 seconds when a printing speed is 15 m/min. However, the time period is suitably changed depending also on the temperature of the warm air.

Further, the web-shaped print base material 12 having the aqueous inks discharged thereto is conveyed through a drying zone 22. As the drying zone 22, there may be used a drying machine. In the illustrated example, an illustration is given of an example using a heating box 24. The heating box 24 is covered with heat insulation walls 26 having a heat insulation structure, and has an inlet 28 for the web-shaped print base material 12 and an outlet 30 for the web-shaped print base material 12.

The heating box 24 is heated in advance (preheating) to a temperature of from 60° C. to 70° C. The inside of the heating box 24 may be heated with warm air or may be heated with a heater among various publicly known heaters. In the illustrated example, an illustration is given of a configuration in which the inside of the heating box 24 is heated with warm air.

Moreover, various rollers 32, 34, 36, 38, 40, 42, 44, 46, 48, 50, 52, 54, 56, and 58 for conveying the web-shaped print base material 12 are provided. The web-shaped print base material 12 is conveyed with the above-mentioned rollers and sent to the adjacent winding portion 20. The reference symbol O denotes an operator of the inkjet printer.

As described above, the unwinding portion 14 and the adjacent winding portion 20 are both installed side by side in an uneven arrangement on any one of the upstream side U and the downstream side D of the single-pass inkjet head portion 18. Thus, the operator O can easily replace the web-shaped print base material 12 on the unwinding portion 14 and the adjacent winding portion 20 for the web-shaped print base material 12. Therefore, the inkjet printer 10 with an unwinding portion and an adjacent winding portion in an uneven arrangement is extremely easy to use.

Therefore, the inkjet printer 10 with an unwinding portion and an adjacent winding portion in an uneven arrangement can deal with the small-lot and wide-variety printing. Further, the inkjet printer 10 with an unwinding portion and an adjacent winding portion in an uneven arrangement requires an installation space which is only about one-half the installation space for the related-art inkjet printers, thereby being capable of also achieving space saving.

REFERENCE SIGNS LIST

10: inkjet printer with unwinding portion and adjacent winding portion in an uneven arrangement, 12: web-shaped print base material, 14: unwinding portion, 16: surface of web-shaped print base material, 18: single-pass inkjet head portion, 18*a* to 18*e*: inkjet head, 20: adjacent winding portion, 22: drying zone, 24: heating box, 26: heat insulation wall, 28: inlet, 30: outlet, 32, 34, 36, 38, 40, 42, 44, 46, 48, 50, 52, 54, 56, 58: roller, 60*a* to 60*e*: surface heating portion, D: downstream side of inkjet head portion, O: operator, U: upstream side of inkjet head portion.

The invention claimed is:

1. An inkjet printer for aqueous ink with an unwinding portion and an adjacent winding portion in a lopsided arrangement, comprising:

the unwinding portion for a web-shaped print base material, in which the unwinding roll of the unwinding portion is rotated through use of a drive belt;

a single-pass inkjet head portion configured to discharge an aqueous ink to a surface of the web-shaped print base material unwound by a single-pass method;

the adjacent winding portion, which is provided adjacent to the unwinding portion, and is configured to wind the web-shaped print base material, in which the winding roll of the adjacent winding is rotated through use of a drive belt;

a single motor;

a surface heating portion which are configured to heat at least a surface of the web-shaped print base material having the aqueous inks discharged thereto; and a heating box, in which the web-shaped print base material having the aqueous inks discharged thereto, is conveyed on a roll inside the heating box, wherein the heating box is covered with heat insulation walls having a heat insulation structure, and has an inlet for the web-shaped print base material and an outlet for the web-shaped print base material, wherein the unwinding portion and the adjacent winding portion are both installed side by side in an uneven a lopsided arrangement on one of an upstream side and a downstream side of the single-pass inkjet head portion, wherein the unwinding roll of the unwinding portion and the winding roll of the adjacent winding portion are rotated in synchronization with each other through use of the single motor.

2. The inkjet printer according to claim 1, wherein the unwinding portion and the adjacent winding portion are installed side by side in a lopsided arrangement on an upstream side of the single-pass inkjet head portion.

3. The inkjet printer according to claim 1, wherein the unwinding portion and the adjacent winding portion are arranged on one side of the heating box.

4. An inkjet printer for aqueous ink, the inkjet printer comprising:

an unwinding portion for a web-shaped print base material, the unwinding portion comprising an unwinding roll, the unwinding roll being configured to rotate via a first drive belt;

a single-pass inkjet head portion configured to discharge an aqueous ink to a surface of the web-shaped print base material unwound via a single-pass method;

an adjacent winding portion arranged adjacent to the unwinding portion, the adjacent winding portion being configured to wind the web-shaped print base material, the adjacent winding portion comprising a winding roll, the winding roll being configured to rotate via a second drive belt;

a single motor configured to rotate the unwinding roll of the unwinding portion and the winding roll of the adjacent winding portion such that the unwinding roll and the winding roll are rotated in synchronization with each other;

a surface heating portion configured to heat at least a surface of the web-shaped print base material having the aqueous inks discharged thereto; and a heating box comprising a heating box roll arranged in an interior space of the heating box, the heating box roll being configured to receive the web-shaped print base material having the aqueous inks discharged thereto, wherein the heating box is covered with heat insulation walls having a heat insulation structure, the heating box comprising an inlet for the web-shaped print base material and an outlet for the web-shaped print base material, wherein the unwinding portion and the adjacent winding portion are both installed side by side on one of an upstream side and a downstream side of the single-pass inkjet head portion.

5. The inkjet printer according to claim 4, wherein the unwinding portion and the adjacent winding portion are arranged on one side of the heating box.

6. An inkjet printer for aqueous ink, the inkjet printer comprising:

an unwinding portion for a web-shaped print base material, the unwinding portion comprising an unwinding roll, the unwinding roll being configured to rotate via a first drive belt;

a single-pass inkjet head portion configured to discharge an aqueous ink to a surface of the web-shaped print base material unwound via a single-pass method;

a winding portion arranged side by side with the unwinding portion, the winding portion being configured to wind the web-shaped print base material, the winding portion comprising a winding roll, the winding roll being configured to rotate via a second drive belt;

a single motor configured to rotate the unwinding roll of the unwinding portion and the winding roll of the winding portion such that the unwinding roll and the winding roll are rotated in synchronization with each other;

a surface heating portion configured to heat at least a surface of the web-shaped print base material having the aqueous inks discharged thereto; and a heating box comprising a heating box roll arranged in an interior space of the heating box, the heating box roll being configured to receive the web-shaped print base material having the aqueous inks discharged thereto, wherein the heating box is covered with heat insulation walls having a heat insulation structure, the heating box comprising an inlet for the web-shaped print base material and an outlet for the web-shaped print base material, wherein the unwinding portion and the winding portion are arranged on an upstream side of the single-pass inkjet head portion.

7. The inkjet printer according to claim 6, wherein the unwinding portion and the winding portion are arranged on one side of the heating box.

* * * * *